US008826707B2

(12) United States Patent
Habecke

(10) Patent No.: US 8,826,707 B2
(45) Date of Patent: Sep. 9, 2014

(54) LOCKING DEVICE COMPRISING A KEY AND A LOCKING CYLINDER

(75) Inventor: Matthias Habecke, Hattingen (DE)

(73) Assignee: Huf Hulsbeck & Furst GmbH & Co. KG (DE)

( * ) Notice: Subject to any disclaimer, the term of this patent is extended or adjusted under 35 U.S.C. 154(b) by 208 days.

(21) Appl. No.: 12/736,414

(22) PCT Filed: Apr. 10, 2008

(86) PCT No.: PCT/EP2008/003070

§ 371 (c)(1),
(2), (4) Date: Oct. 6, 2010

(87) PCT Pub. No.: WO2009/124571

PCT Pub. Date: Oct. 15, 2009

(65) Prior Publication Data

US 2011/0041575 A1 Feb. 24, 2011

(51) Int. Cl.
*E05B 27/00* (2006.01)
*E05B 29/00* (2006.01)
*E05B 19/00* (2006.01)

(52) U.S. Cl.
CPC ..... *E05B 29/00* (2013.01); *E05B 19/0017* (2013.01); *E05B 19/0052* (2013.01)
USPC ..... 70/357; 70/358; 70/492; 70/409; 70/416

(58) Field of Classification Search
USPC ..... 70/350–352, 357, 358, 377, 490–492, 70/405, 406, 407, 409
See application file for complete search history.

(56) References Cited

U.S. PATENT DOCUMENTS

| | | | | | |
|---|---|---|---|---|---|
| 2,039,126 | A | * | 4/1936 | Svoboda | 70/358 |
| 2,123,940 | A | * | 7/1938 | Gray | 70/492 |
| 3,035,433 | A | * | 5/1962 | Testa | 70/495 |
| 4,075,879 | A | * | 2/1978 | Christopher | 70/337 |
| 4,148,201 | A | * | 4/1979 | Miyamae et al. | 70/358 |

(Continued)

FOREIGN PATENT DOCUMENTS

| | | |
|---|---|---|
| DE | 19829521 | 3/1999 |
| DE | 19944070 | 4/2001 |

(Continued)

*Primary Examiner* — Suzanne Barrett
(74) *Attorney, Agent, or Firm* — Cantor Colburn LLP

(57) ABSTRACT

A locking device comprises a key (10) and a locking cylinder (30). The locking cylinder (30) in turn is composed of a stationary cylinder housing (31) and a cylinder core (32) rotatably supported therein. In order to increase the break-in safety, it is proposed to use two types of plate closures (40, 50) in the cylinder core (32), the displacement of that closure pointing into two radial directions (41, 51) that differ from each other. The key (10) comprises planar outer surfaces (12, 13) disposed at an angle to each other, the two types of plate closures (40, 50) being parallel displaceable to said surfaces. Each of the two adjoining outer surfaces (12, 13) has a dedicated linear control path (21, 22), which varies in adjoining key sections transversely to the key longitudinal direction (29) for coding the key (10). Accordingly, the plate closures (40, 50) have a pair of mating sampling sites (42, 52), which are disposed in defined positions and interact with the associated control path (21, 22) when the key (10) is inserted and generate a mating coding analogous thereto in the locking cylinder (30). Each of the two types of plate closures (40, 50) engages on the dedicated control path (21, 22) thereof.

19 Claims, 4 Drawing Sheets

(56) References Cited

U.S. PATENT DOCUMENTS

Figure 1:
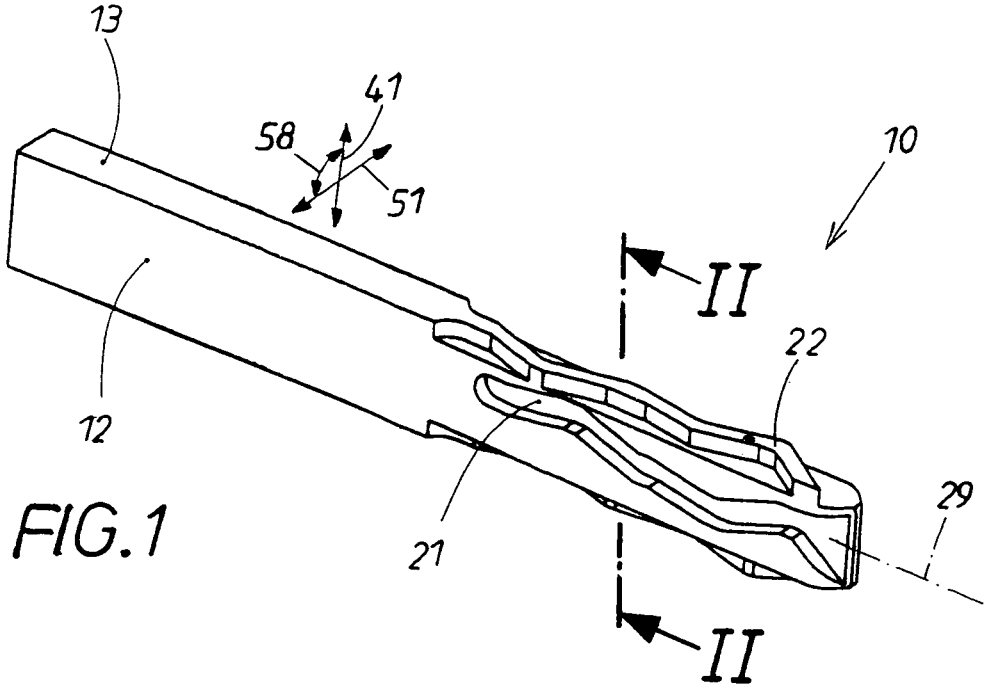

| | | | | |
|---|---|---|---|---|
| 4,434,636 | A * | 3/1984 | Prunbauer | 70/358 |
| 4,612,787 | A * | 9/1986 | Prunbauer et al. | 70/358 |
| 4,977,767 | A * | 12/1990 | Prunbauer | 70/406 |
| 5,174,141 | A * | 12/1992 | Ohyabu | 70/492 |
| 7,159,424 | B2 * | 1/2007 | Widen | 70/409 |
| 7,240,525 | B2 * | 7/2007 | Gil | 70/340 |
| 7,424,815 | B1 * | 9/2008 | Pagnoncelli | 70/340 |
| 7,484,392 | B2 * | 2/2009 | Katagiri | 70/492 |
| 7,634,930 | B2 * | 12/2009 | Boesel et al. | 70/383 |
| 7,673,484 | B1 * | 3/2010 | Crepinsek | 70/419 |
| 7,690,232 | B2 * | 4/2010 | Klein et al. | 70/409 |
| 7,870,771 | B2 * | 1/2011 | Mueller et al. | 70/409 |
| 8,261,587 | B2 * | 9/2012 | Haviv et al. | 70/416 |
| 8,261,588 | B2 * | 9/2012 | Sabata | 70/492 |
| 8,276,419 | B2 * | 10/2012 | Farrenkothen et al. | 70/492 |
| 8,327,675 | B2 * | 12/2012 | Baumann | 70/494 |
| 2003/0037579 | A1 * | 2/2003 | Wu | 70/358 |
| 2003/0154752 | A1 * | 8/2003 | Price | 70/358 |
| 2004/0000178 | A1 * | 1/2004 | Tseng | 70/358 |
| 2005/0268678 | A1 * | 12/2005 | Price | 70/358 |
| 2006/0000251 | A1 | 1/2006 | Ceron et al. | |
| 2007/0006623 | A1 * | 1/2007 | Barrenberg et al. | 70/492 |
| 2009/0025442 | A1 * | 1/2009 | Klein et al. | 70/492 |
| 2009/0266123 | A1 * | 10/2009 | Mueller et al. | 70/348 |
| 2011/0302972 | A1 * | 12/2011 | Higuchi | 70/491 |
| 2012/0279265 | A1 * | 11/2012 | Winkler et al. | 70/358 |
| 2012/0297843 | A1 * | 11/2012 | Jacob | 70/358 |
| 2013/0000368 | A1 * | 1/2013 | Habecke | 70/358 |

FOREIGN PATENT DOCUMENTS

| | | |
|---|---|---|
| DE | 2025010309 | 12/2005 |
| DE | 102007014900 | 10/2008 |
| EP | 0613987 | 9/1994 |
| WO | 2007028484 | 3/2007 |

* cited by examiner

LOCKING DEVICE COMPRISING A KEY AND A LOCKING CYLINDER

The invention is directed to a closure device of the kind indicated in the preamble of the claim 1. Such a device is known from the German patent 19944 070 C2. There, the key is formed as a flat key, which has a control groove for projections of corresponding platelet tumblers on its broad outer face. Since here a reversible key is concerned, agreeing and fitting control grooves are inserted at the broad faces disposed opposite to each other. A straight line flute is disposed at the narrow sides for typing the key, which flute does not cooperate with the platelet tumblers.

Such closure devices equipped with platelet tumblers have proven useful in connection with motor vehicles. Unauthorized persons make an effort with break-in tools for stealing a motor vehicle, for example by a so-called "picking system", to sort the platelet tumblers in the key channel to the cross-section of the cylinder core, whereby the regularly spring-loaded platelet tumblers release of the cylinder core for rotation.

It is an object of the present invention to develop a reliable closure device of the kind recited in the preamble of claim 1, wherein the reliable closure device is characterized by a high safety against break-in. This is achieved by the features recited in the characterizing part of claim 1, which have the following particular characteristics.

Since the platelet tumblers of the two types are shiftable in different radial directions from each other, it is not possible without further steps to open the closure cylinder by way of a break-in tool. Depending on the position of the different platelet tumblers, one would need different tools, wherein the handling of the different tools is mutually interfering.

This is in particular then the situation where the control tracks for the two types of the platelet tumblers are formed opposite to each other, that is on the one hand concave or on the other hand convex. The one type can exhibit control tracks in the form of a control groove and the other type in the form of a control rib. Correspondingly, the counter sensing position pairs are formed oppositely in these two types. The counter sensing position pairs in case of a control groove are formed from the counter flanks of a radial projection, wherein the radial projection engages into the control groove. The counter sensing position pairs of in case of a control rib are formed of a radial recess, wherein the flanks directed opposite to each other serve for gripping around the control rib. The platelet tumblers with projections namely cannot be adjusted with those break-in tools, which would be required by the platelet tumblers with projections. Therefore the closure devices according to the present invention are very safe against break-in.

Figure 2:
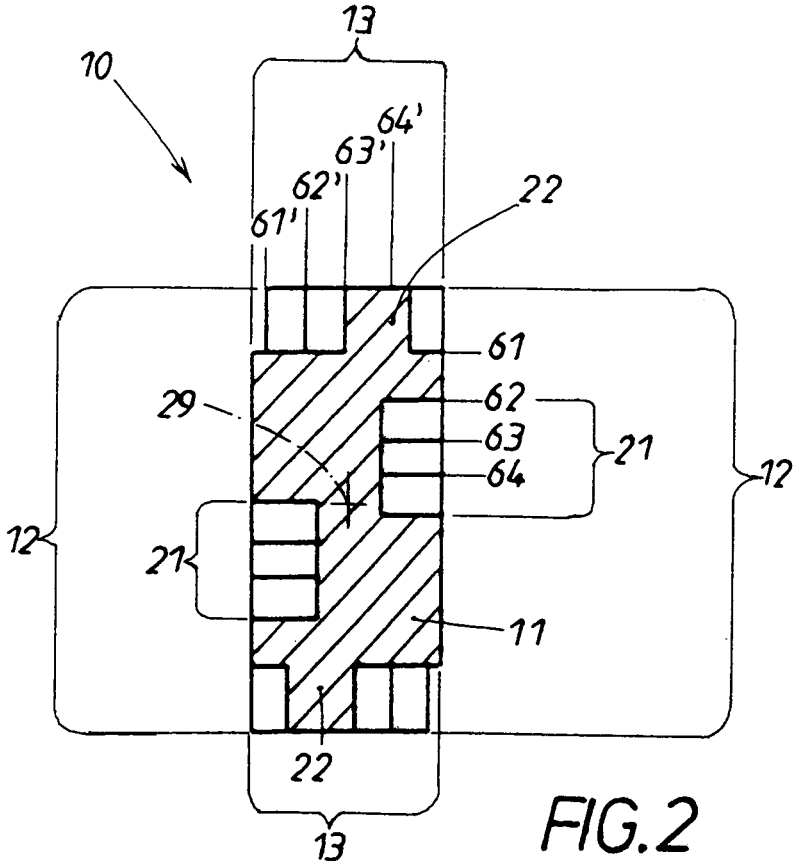
Figure 3:
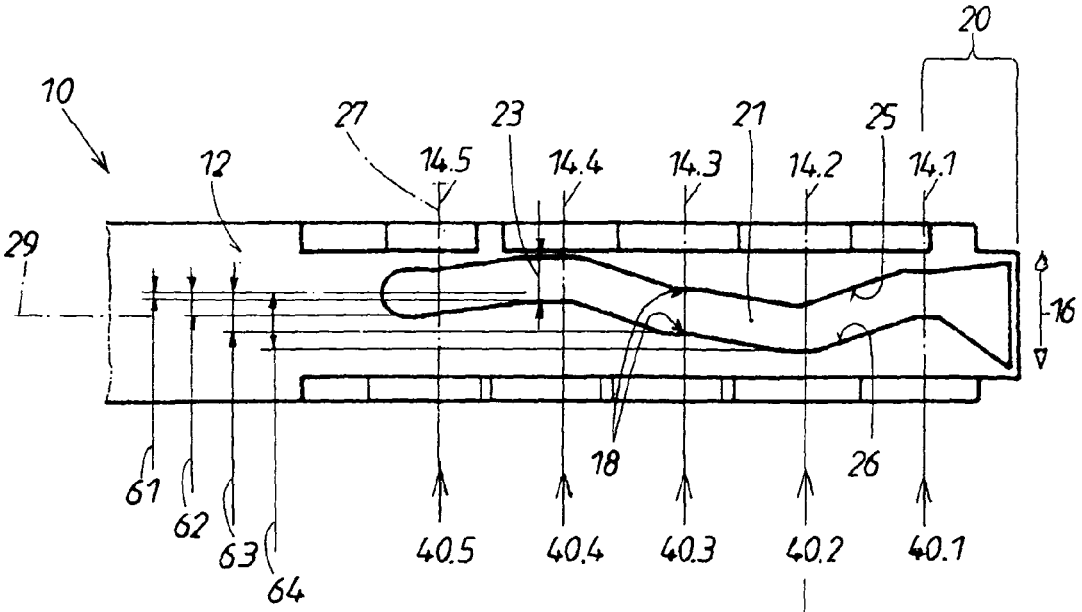
Figure 4:
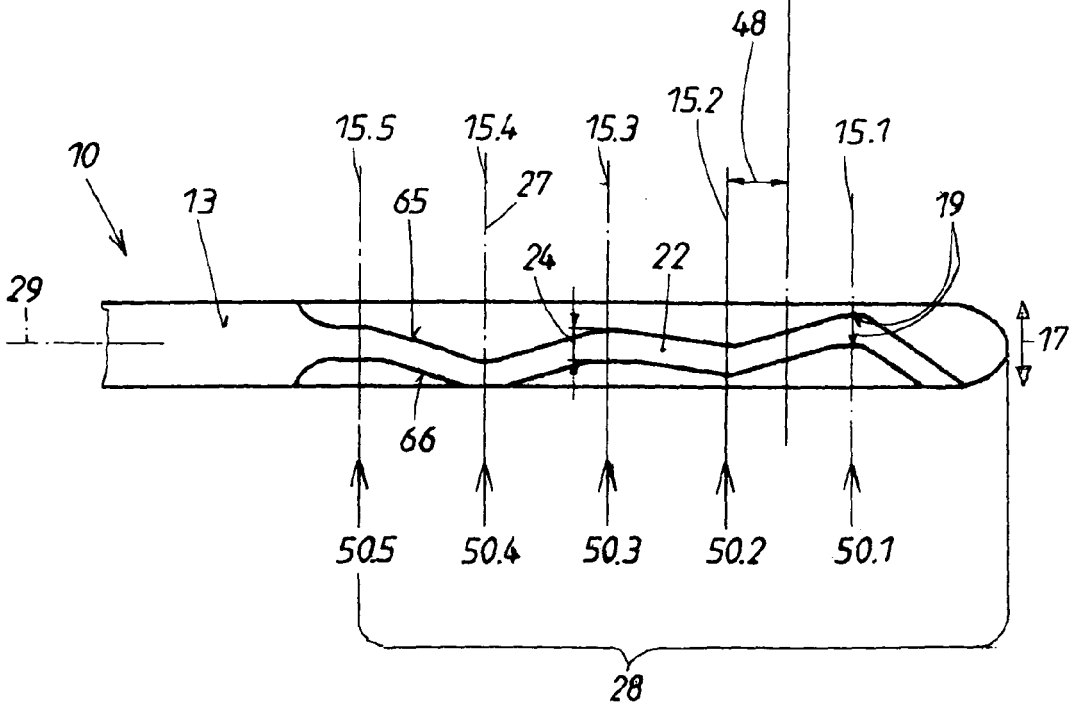
Figure 5A:
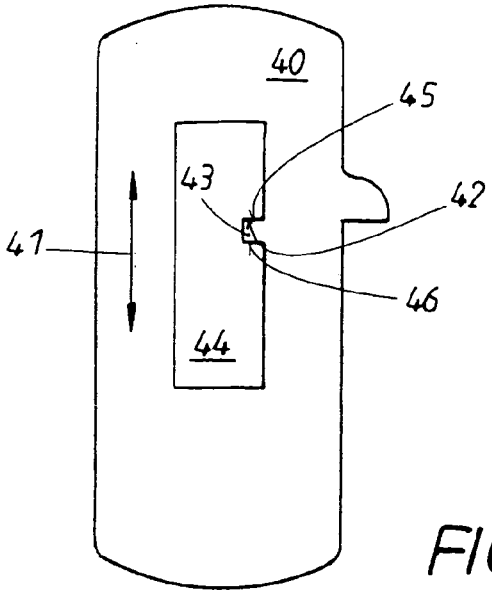
Figure 5B:
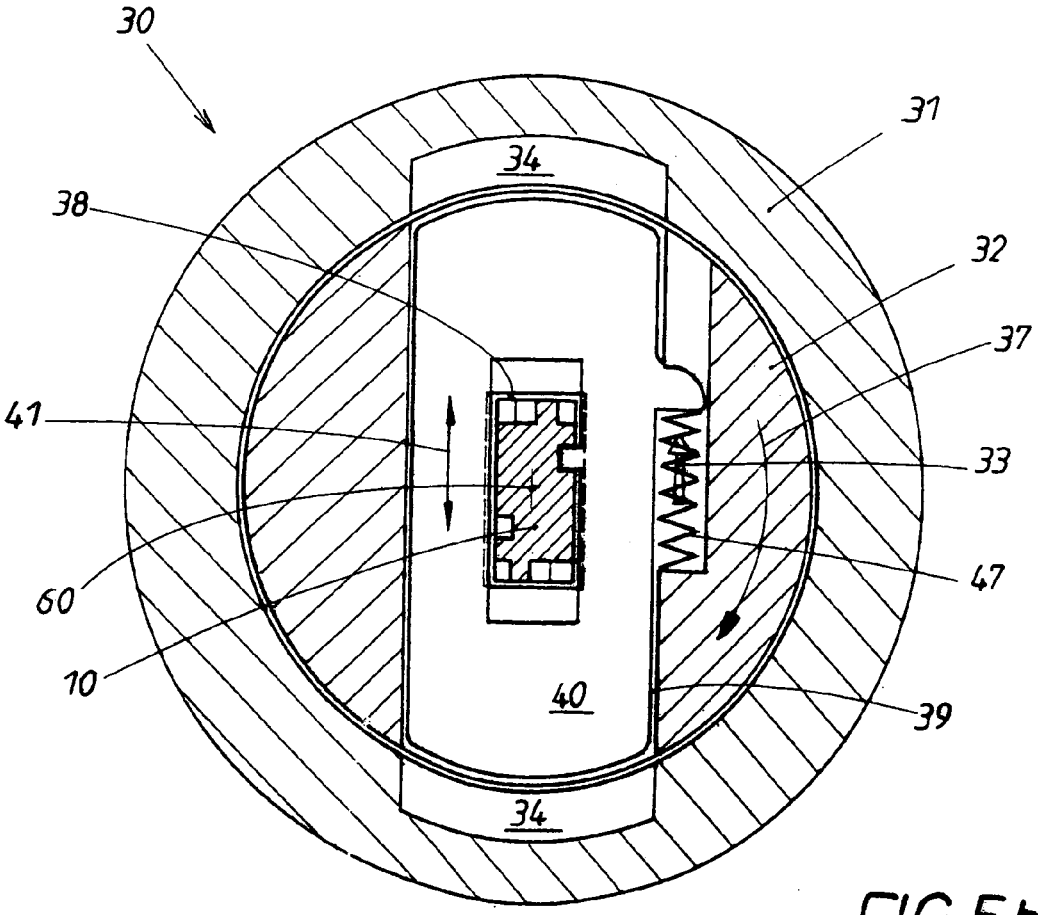
Figure 6A:
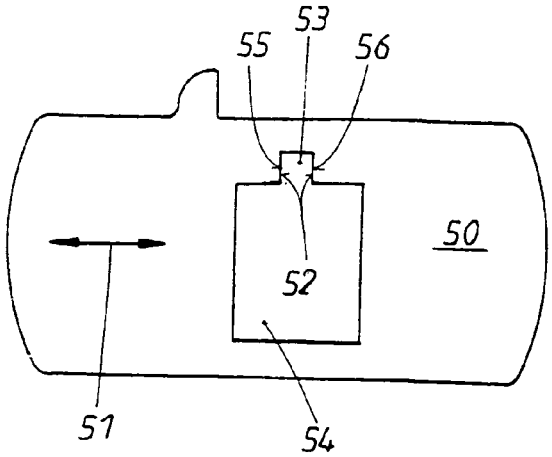
Figure 6B:
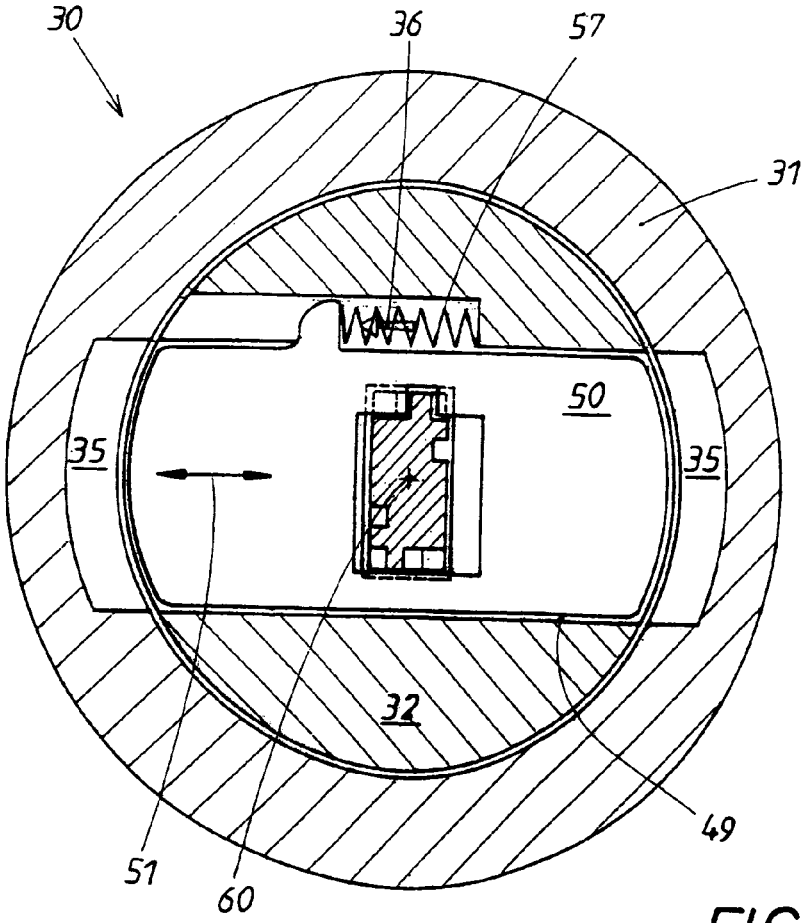

Further steps and advantages of the invention result from the sub claims, the following description and the drawings. The invention is presented in one embodiment example in the drawings. There is shown in:

FIG. 1 a prospective view of the shaft of a key of the invention device,

FIG. 2 an enlarged cross-section through the key of FIG. 1 along this section line II-II of FIG. 1, wherein in this case the key is a flat profile with two narrow and two broad outer faces, FIG. 3 a side elevational view of the invention key with a direction of view to a broad outer face of the flat key, FIG. 4 a top planar view onto the narrow outer face of the key of FIG. 1, 2, FIG. 5*a* an enlarged top planar view onto a platelet tumbler of a first type in the locking cylinder of the device of the present invention, FIG. 5*b* a schematic presentation not to scale of a cross-section through the locking device according to the present invention with view onto the platelet tumbler of FIG. 5*a* with inserted proper key, FIG. 6*a* in a presentation analogous to that of FIG. 5*a* showing a top planar view onto a second kind of platelet tumblers, which are arranged in alternating sequence with those of the FIG. 5*a* in the same cylinder core of the locking device according to the present invention, FIG. 6*b* in a presentation corresponding to that of FIG. 5*b* showing a cross-section through the locking device according to the present invention with inserted key from which the interaction of the key with the tumbler platelet of the second type of FIG. 6*a* results.

FIGS. 1 and 2 show the particular key 10 belonging to the locking device according to the present invention, wherein the cross-section 11 of the key 10 is a flat profile. The flat profile is a rectangular cross-section with two broad outer faces 12 and with two narrow outer faces 13 in each case disposed pair wise opposite to each other. All four outer faces 12,13 are furnished with control tracks 21,22. Outer faces 12, 13 immediately neighboring to each other are equipped with control tracks formed opposite to each other, namely at the broad outer faces 12 there the control track is formed as a control groove 21, whereas in each case a control rib 22 is disposed at the narrow outer faces 13. While the one control track 21 is formed concavely and is recessed from its outer face 12, the second control track 22 is formed convexly and projects from the outer face 13 of the key 10. The control groove 21 has an essentially constant breadth 23 of the groove apart from the initial section 20 of the control groove 21. An analogous situation holds also for the control rib 22, which also exhibits an essentially constant breadth 24 of the rib when viewed in the plane of the cross-section of the key.

The key 10 cooperates with a lock cylinder 30 belonging to the locking device according to the present invention. The lock cylinder 30 comprises a stationary fixed cylinder housing 31, wherein a cylinder core 32 is rotatably supported in the cylinder housing 31. The cylinder core 32 has two kinds 39, 49 of axially successively disposed chambers 39, wherein two different types 40,50 of tumbler platelets are disposed in alternating sequence in the chambers 39, wherein the view of the tumbler platelets will result from FIGS. 5*a*, 5*b*. The one chamber kind 39 extends parallel to the broad outer face 12 of the inserted key 10, while the other kind 49 runs at an angle thereto, in particular perpendicular thereto, namely parallel to the narrow outer face 13 of the inserted key 10. The associated spring-loadings 33, 36 are illustrated by force arrows in FIGS. 5*b*, 6*b*, wherein the spring loadings 33,36 are generated by springs 47, 57 disposed at an angle relative to each other and wherein the springs 47, 57 strive to press the platelet tumblers 40, 50 on their end side into one of two diametrically locking channels 34,35 in case of a missing key or in case of a false key. Then the cylinder core 32 is blocked in the cylinder housing 31 and is not rotatable in the sense of the arrow 37.

The associated regular key 10 has to be inserted into an axial key channel 38 for performing a rotation 37 of the cylinder core 32. Only then the tumblers 40, 50 are sorted onto the cross-section of this cylinder core 32 recognizable in the FIGS. 5*b* and 6*b*. The cylinder core 32 can be rotated by the key from a rest position recognizable in FIGS. 5*b*, 6*b* into one of several work positions, whereby certain functions are triggered in the associated vehicle. The functions are suitable for a securing and releasing of locks and/or for starting, switching on or switching off of a motor in the vehicle and/or for an unbolting or a bolting of the steering of a vehicle.

Both the control groove 21 as well as the control rib 22 in each case have sensing position pairs 18 or 19 for the interaction between key 10 and platelet tumblers 40, 50 respectively. The sensing position pairs 18 or 19 are formed in each case by the groove flanks 25, 26 or by the rib flanks 65, 66 according to FIGS. 3 or 4 respectively. Both the control groove 21 as well as the control rib 22 have an essentially constant groove breadth 23 or, respectively, rib breadth 24 over their complete control length. Case-by-case this can also be realized by different breadth 23,24 in different key sections. The sensing positions at the respective control tracks 21, 22 marked in FIGS. 3 and 4 with 14.1 to 14.5 on the one hand and with 15.1 to 15.5 on the other hand are decisive at the respective control tracks 21, 22, wherein either the first type 40 or the second type 50 of the platelet tumblers engages the respective control tracks 21,22. These positions are marked in FIG. 3 by arrows and are designated by 40.1 to 40.5, whereas these are the sensing position 50.1 to 50.5 in FIG. 4, wherein the second type 50 of the platelet tumblers engages in case of use of the locking device with inserted key 10.

The sequential arrangement of the two types 40, 50 of the two platelet tumblers is The chambers 39 or 49 for the platelet tumblers 40 or 50 respectively are staggered relative to each other by a measure 48 recognizable from FIG. 4. The tumblers of the other type 40 are disposed in the middle of the distance between the platelet tumbler type 50. In each case only one of the corresponding control tracks 21 or 22 resting on the two oppositely disposed outer faces 12 or 13 respectively is used. This allows the use of the key as a so-called "reversible key". It is to be understood that the two types 40, 50 of the platelet tumblers can also be arranged in a different way in the cylinder core 32. Thus it would be for example possible to furnish a mirror image arrangement of the associated platelet tumblers 40 at the arrangement positions 40.2 and 40.4 clarified in FIG. 3 and versus the other arrangement positions 40.1, 40.3, 40.5. Then the projections 43 grip the front side control groove 21 in one case and in another case into the backside analogous control groove of the key 10. The function as the reversible key is here retained. Analogous considerations hold also for the other type 50.

Varying the position of the sensing locations 18 or 19 in the control groove 21 or the control rib 22 in the perpendicular directions 16 or 17 respectively results in a coding of the key. Four step heights 61 to 64 for the groove sensing position 18 are furnished in the present case as is shown in FIGS. 2 and 3. There are four analogous step heights 61' to 64' for the arrangement of the control rib 22. It is to be understood that the variations 61 to 64 for the control groove 21 can be formed different as desired from the variations 61' to 64' of the control rib 22.

It is important that the direction of the shifts 41, 51 of the two sided types 40, 50 of platelet tumblers are arranged at an angle 58 to each other, wherein the angle 58 results from FIG. 1. This angle 58 is a right angle in the present embodiment example because of said rectangular cross-section 11.

LIST OF REFERENCE CHARACTERS

10 key
11 key cross-section, flat profile
12 broad outer face of 10
13 narrow outer face of 10
14.1 first sensing position at 10 for 40 (FIG. 3)
14.2 second sensing position at 10 for 40 (FIG. 3)
14.3 third sensing position at 10 for 22 (FIG. 3)
14.4 fourth sensing position at 10 for 22 (FIG. 3)
14.5 fifth sensing position at 10 for 22 (FIG. 3)
15.1 first sensing position of 10 on 22 (FIG. 4)
15.2 second sensing position of 10 on 22 (FIG. 4)
15.3 third sensing position of 10 on 22 (FIG. 4)
15.4 fourth sensing position of 10 on 22 (FIG. 4)
15.5 fifth sensing position of 10 on 22 (FIG. 4)
16 cross direction for variation of 21 in 12 (FIG. 3)
17 cross direction for variation of 22 in 13 (FIG. 4)
18 sensing position pair at 14.1 to 14.5 (FIG. 3)
19 sensing position pair of 22 and 15.1 to 15.5 (FIG. 4)
20 start piece of 21
21 linear control track, first type, control groove
22 linear control track, second type, control rib
23 track breadth of 21, groove breadth
24 track breadth of 22, rib breadth
25 first groove flank of 18
26 second groove flank of 18
27 plane of cross-section of 10
28 control effective key length of 10
29 key longitudinal direction of 10
30 lock cylinder
31 cylinder housing of 30
32 cylinder core of 30
33 spring loading of 40
34 blocking channel for 40 in 32
35 blocking channel for 50 in 32
36 spring loading for 50
37 rotary arrow of 32
38 key channel for 10 in 32
39 first kind of chambers in 32 for 40 (FIG. 5*b*)
40 first type of the platelet tumblers (FIG. 5*a*, 5*b*)
40.1 first attack position of 40 in 21 (FIG. 3)
40.2 second attack position of 40 in 21 (FIG. 3)
40.3 third attack position of 40 in 21 (FIG. 3)
40.4 fourth attack position of 40 in 21 (FIG. 3)
40.5 fifth attack position of 40 in 21 (FIG. 3)
41 shifting direction of 40 (FIG. 5*b*)
42 counter sensing position pair at 40 (FIG. 5*a*)
43 radial projection of 40 (from FIG. 5*a*)
44 window in 40 for 10 (FIG. 5*a*)
45 first counter flank of 43 (FIG. 5*a*)
46 second counter flank of 43 (FIG. 5*a*)
47 spring for 53 (FIG. 5*b*)
48 offset of the arrangement between 40, 50 in 32 (FIG. 4)
49 second kind of chambers in 32 for 50 (FIG. 6*b*)
50.1 first sensing position of 50 at 22
50.2 second sensing position of 50 at 22
50.3 third sensing position of 50 at 22
50.4 fourth sensing position of 50 at 22
50.5 fifth sensing position of 50 at 22
51 shifting direction of 50 (FIG. 6*a*)
52 counter sensing position pair of 50 (FIG. 6*a*)
53 radial recess in 50 for 10 (FIG. 6*a*)
54 window in 50 for 10 (FIG. 6*a*)
55 first counter flank of 52 (FIG. 6*a*)
56 second counter flank of 52 (FIG. 6*a*)
57 spring for 36 (FIG. 6*b*)
58 angle between 41, 51 (FIG. 1)
60 cylinder axis of 30 (FIG. 5*a*, 5*b*)
61 first step height of 18 (FIG. 2,3)
61' first step height of 19 (FIG. 2)
62 second step height of 18 (FIG. 2,3)
62' second step height of 19 (FIG. 2)
63 third step height of 18 (FIG. 2,3)
63' third step height of 19 (FIG. 2)
64 fourth step height of 18 (FIG. 2,3)
64' fourth step height of 19 (FIG. 2)

65 first rib flank of 22 (FIG. 4)
66 second rib flank of 22 (FIG. 4)

The invention claimed is:

1. Lock device with a key (10) and with a lock cylinder (30), comprising a spatially fixed cylinder housing (31) with a plurality of platelet tumblers, wherein the platelet tumblers are radially shiftable relative to a cylinder axis (39)during insertion of the key (10) into an axial key channel (38) of the cylinder core (32) in order to sort the platelet tumblers on a cross-section of the cylinder core (32), wherein the key (10) has an edge profile with several planar outer faces (12, 13) running at an angle to each other, wherein a control track extends in a longitudinal direction (29) of the key on an outer face and exhibits a pair of sensing positions (18, 19) for each of the platelet tumblers engaging the control track, wherein the sensing positions are disposed opposite to each other in a key cross-section (11), wherein for a coding the position of the sensing position pairs (18, 19) of the control track in the successively following key sensing positions (14.1 to 14.5, 50.1 to 15.5) varies in a direction (16, 17) perpendicular to the key longitudinal direction (29), and wherein for an analogous counter coding the platelet tumblers are located parallel to the cross-section of the cylinder core (32) and engage a corresponding sensing position pair (18, 19) of the control track when the key (10) is inserted, characterized in that at least two types (40, 50) of platelet tumblers are disposed in the cylinder core (31), wherein the platelet tumblers can be shifted in two radial directions (41, 51) different from each other, since the platelet tumblers of a first type (40) can be shifted (41) parallel to a first outer face (12) of the key (10) and the platelet tumblers of a second type (50) can be shifted (51) parallel to a neighboring second outer face (13), wherein a first control track (21) of the first type (40) of the platelet tumblers is positioned at the first outer face (12) of the key (10) and a second control track (22) of the second type (50) is positioned at the second outer face (13), wherein counter sensing positions (42) of the platelet tumblers of the first type (40) engage the first control track (21) and the counter sensing positions (52) of the second type (50) engage the second control track (22), wherein the key (10) has a multi-edge profile with several planar outer faces (12, 13), each of the outer faces (12, 13) having control tracks, and wherein the control tracks are formed either as a control groove (21) or as a control rib (22), and wherein the first control track and the second control track (21,22) mainly have a constant track breadth apart from an initial section (20) at the free end of the key.

2. Lock device according to claim 1, wherein the distance between the two counter sensing positions of an associated pair (42; 52) of the platelet tumblers of the first and/or second type (40; 50) is formed almost uniformly in the complete cylinder core.

3. Lock device according to claim 1, wherein the distance between the sensing positions of the sensing position pair (18, 19) at the first and/or second control track (21, 22) is formed almost uniformly over the complete key length (28) effectively used for coding.

4. Lock device according to claim 1, wherein the first or second control track consist of a control groove (21).

5. Lock device according to claim 1, wherein the first or second control track consists of a control rib (22).

6. Lock device according to claim 4 and wherein the first control track is a control groove (21) and wherein the neighboring second control track is a control rib (22).

7. Lock device according to claim 1, wherein the key (10) exhibits a four edge profile and all four planar outer faces (12, 13) are furnished either with a control groove (21) or with a control rib (22), and that at neighboring outer faces in alternating sequence a control groove (21) and a control rib (22) are arranged.

8. Lock device according to claim 7, wherein the key (10) exhibits a four edge flat profile (11), which has two narrow and two broad outer faces (13, 12) disposed opposite to each other.

9. Lock device according to claim 7, wherein the two outer faces (12 or, respectively, 13) disposed opposite to each other in the four edge profile of the key (10) are furnished with same control track profiles, and wherein the key (10) is a "reversible key", which can be inserted in the cylinder core (32) in a reversed position.

10. Lock device according to claim 7, wherein the control tracks, located on the outer faces (12, 13) disposed opposite to each other, are formed either as a control groove (21) or as a control rib (22).

11. Lock device according to claim 7, wherein at a key (10) with a flat profile (11) there are disposed control ribs (22) at the narrow outer faces (13) and control grooves (21) at the broad outer faces (12).

12. Lock device according to claim 1, wherein the platelet tumblers of the fist and the second type (40, 50) are arranged in an alternating sequence in the cylinder core (32).

13. Lock device according to claim 4, wherein the sensing position pairs (18) at a control groove (21) consist of two groove flanks (25, 26), which are disposed in the same plane (27) as the cross-section (11) of the key (10) and are directed opposite to each other.

14. Lock device according to claim 5, wherein the sensing position pairs (19) at a control rib (22) comprise two rib flanks (65, 66), which are disposed in a cross-sectional plane (27) of the key (10) and are directed away from each other.

15. Lock device according to claim 13 wherein the counter sensing positions (52) of the platelet tumblers of the second type (50), which engage a control rib (22) when the key (10) is inserted, are generated by two oppositely directed counter flanks (55, 56) of a radial recess (53) in the platelet tumblers.

16. Lock device according to claim 14 wherein the counter sensing positions (42) of the platelet tumblers of the first type (40), which engage in a control groove (21) when the key (10) is inserted, are generated by two counter flanks (45, 46) directed away from each other of a radial projection (43) of the platelet tumblers.

17. Lock device according to claim 15, wherein the radial projection (43) of the platelet tumblers of the first type (40) are disposed at an angle to the radial recesses (53) of the platelet tumblers of the second type (50).

18. Lock device according to claim 17 wherein the angle is a right angle at the key (10) with flat profile (11) or four edge profile.

19. A key, comprising:

a key body having a plurality of edge profiles, each edge profile having a planar base and a control track configured to interact with a tumbler of a lock, a first control track on a first planar base being a rib extending from the planar base and having a constant width from the planar base to an outer radial surface from a center of the key body, and a second control track on a second planar base being a groove recessed in the planar base and having a mainly constant track breadth along a length of the key body except at a free end of the key, wherein each planar base is at an angle with respect to each neighboring planar base and parallel to a planar base on an opposite side of the key body.

* * * * *